US008567360B2

(12) United States Patent
Bayrakdar

(10) Patent No.: US 8,567,360 B2
(45) Date of Patent: Oct. 29, 2013

(54) CONTROL VALVE

(75) Inventor: Ali Bayrakdar, Roethenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 73 days.

(21) Appl. No.: 13/392,212

(22) PCT Filed: Jul. 29, 2010

(86) PCT No.: PCT/EP2010/061009

§ 371 (c)(1),
(2), (4) Date: Feb. 24, 2012

(87) PCT Pub. No.: WO2011/023488

PCT Pub. Date: Mar. 3, 2011

(65) Prior Publication Data

US 2012/0152189 A1 Jun. 21, 2012

(30) Foreign Application Priority Data

Aug. 29, 2009 (DE) ..... 10 2009 039 385

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS 5,207,462 A 5/1993 Bartholomew
5,566,651 A * 10/1996 Strauss et al. ..... 123/90.17
2007/0095315 A1 5/2007 Hoppe et al.

FOREIGN PATENT DOCUMENTS

DE 4218082 A1 12/1993
DE 10211468 A1 9/2003

* cited by examiner

*Primary Examiner* — Zelalem Eshete
(74) *Attorney, Agent, or Firm* — Lucas & Mercanti, LLP

(57) ABSTRACT

A control valve for a device for the variable adjustment of the valve timing of gas exchange valves of an internal combustion engine. The control valve has a substantially hollow-cylindrical valve box, a control piston and a securing ring. The valve box is arranged in a receptacle inside the device, the securing ring projects over the valve box in the radial direction and the control piston is arranged so as to be axially displaceable inside the valve box.

4 Claims, 3 Drawing Sheets

CONTROL VALVE

CROSS-REFERENCE TO RELATED APPLICATIONS

This application is a 371 of PCT/EP2010/061009 filed Jul. 29, 2010, which in turn claims the priority of DE 10 2009 039 385,4 filed Aug. 29, 2009. The priority of both applications is hereby claimed and both applications are incorporated by reference herein.

FIELD OF THE INVENTION

The invention relates to a control valve for a device for variably setting the control times of gas exchange valves of an internal combustion engine with an essentially hollow-cylindrically designed valve housing, a control piston and a securing ring. The valve housing is arranged in a receptacle inside the device, the securing ring projects beyond the valve housing in the radical direction, and the control piston is arranged displaceably inside the valve housing.

BACKGROUND OF THE INVENTION

In modern internal combustion engines, devices for variably setting the control times of gas exchange valves are used in order to be able to variably configure the phase relation between crankshaft and camshaft within a defined angular range between a maximum advance position and a maximum retard position. The device is connected fixedly in terms of rotation to a camshaft and has a plurality of pressure chambers, by means of which a phase relation between the crankshaft and the camshaft can be varied in a directed way by the supply or discharge of pressure medium. The supply of pressure medium to and discharge of pressure medium from the pressure chambers are controlled by means of a control valve.

A device and a control valve are known, for example, from DE 102 11 468 A1. The device comprises a driven element which is arranged rotatably with respect to a drive element and which is connected fixedly in terms of rotation to a camshaft. The drive element is drive-connected to a crankshaft. Inside the device, a plurality of pressure chambers acting opposite to one another are provided, by means of which the phase position of the driven element in relation to the drive element can be set in a directed way within a defined angular range. Directed rotation of the camshaft in relation to the crankshaft can thus be brought about. In DE 102 11 468 A1, the device is of vane type design. However, other forms of construction, such as axial piston adjusters from DE 42 18 082 A1, are also known.

The camshaft is mounted in a cylinder head of the internal combustion engine by means of a plurality of camshaft bearings. Pressure medium is supplied via one of the camshaft bearings to a pressure medium duct formed in the camshaft and can be conducted into the pressure chambers via a control valve which is arranged in a receptacle of the camshaft. The control valve is composed of a valve housing and of a control piston received axially displaceably in the valve housing. The control piston can be positioned in relation to the valve housing in the axial direction, counter to the force of a spring element, by means of an electromagnetic actuating unit and the pressure medium streams are thus controlled.

SUMMARY OF THE INVENTION

The object on which the present invention is based is to specify a control valve, of which the outlay in terms of assembly is to be reduced.

The object is achieved, according to the invention, in that an annular groove is formed on an inner circumferential face of the receptacle, into which annular groove the securing ring can engage. The securing ring bears against an axial side face of the valve housing, and at least one positively locking element is formed on the valve housing. The securing ring is fastened to the valve housing by the positively locking element. Moreover, the positively locking element is formed on the axial side face of the valve housing against which the securing ring bears.

The securing ring serves for fastening the control valve in the receptacle which can be formed, for example, within the camshaft or the inner rotor. The control valve is therefore positioned radially within the device. The securing ring is configured as an elastically deformable component which can be compressed and extended elastically in the radial direction, with the result that its diameter can he reduced and increased from the rest state under the action of force. If the force ceases, the securing ring returns into its original state.

During the mounting of the control valve in the receptacle, the diameter of the securing ring is compressed in the radial direction upon entry into the receptacle by the wall of the latter. When the securing ring passes into the region of the annular groove of the receptacle, it latches into the annular groove. At the same time, said securing ring bears in the axial direction against the valve housing, for example against an axial side face of the valve housing, with the result that the axial position of the valve housing and therefore of the control valve in the receptacle is fixed.

As a result of the positively locking connection of the securing ring with the valve housing, the control valve including securing ring can be supplied to the assembly line as one module. During the mounting of the control valve in the receptacle, only one module has to be mounted, and not two separate components. Moreover, it is ensured that the securing ring is installed during the mounting.

In one development of the invention, it can be provided that two hook-shaped positively locking elements which are spaced apart in the circumferential direction are formed in the region of that side face of the valve housing, against which the securing ring bears, which positively locking elements are configured so as to be open radially to the outside and engage behind the securing ring in the axial direction, with the result that the securing ring bears both against the axial side face of the valve housing and against radially extending sections of the hook-shaped positively locking elements. The radial movability of the securing ring is therefore ensured, as a result of which the mounting is simplified further. The hook-shaped structures hold the securing ring in its predefined position, radial compression being made possible during the mounting. The mounting of the securing ring on the valve housing takes place by virtue of the fact that the securing ring is first of all bent open elastically in the radial direction with an increase in its diameter and is inserted into the hooks. Subsequently, the action of force which has led to the increase in the diameter is ended and the securing ring returns into its original state, with the result that said securing ring is received captively in the hooks.

In one advantageous development of the invention, it is provided that the securing ring has a radially inwardly extending section which serves as an axial stop for the control piston. As a result, the components which are arranged within the valve housing, such as the control piston, spring element and sleeves which are possibly arranged between the valve housing and the control piston, are secured captively, with the result that the entire control valve can be supplied to the assembly line and installed as one module.

BRIEF DESCRIPTION OF THE DRAWINGS

Further features of the invention may be gathered from the following description and from the drawings which illustrate exemplary embodiments of the invention in simplified form and in which.

DETAILED DESCRIPTION OF THE INVENTION

Figure 1:
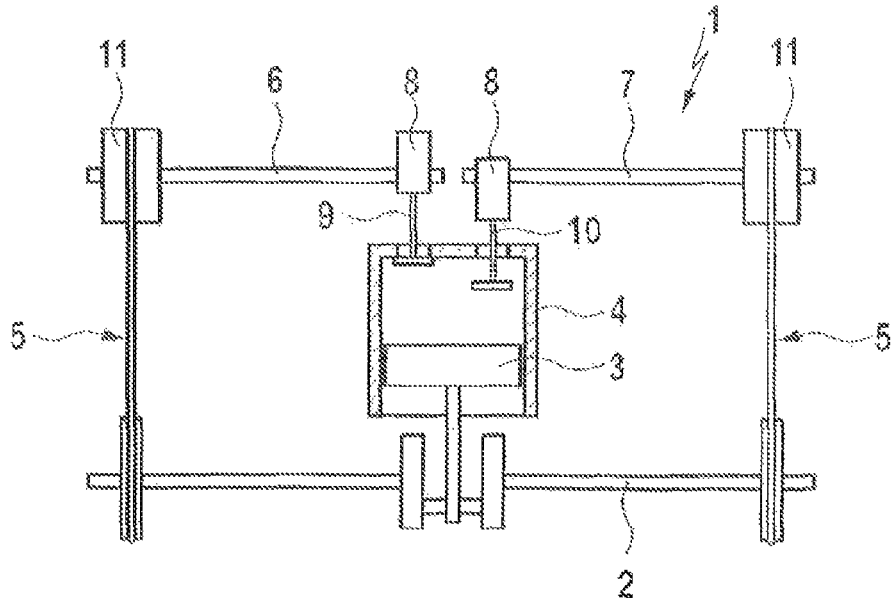
FIG. 1 shows an internal combustion engine only highly diagrammatically.

An internal combustion engine 1 is sketched in FIG. 1. A piston 3 seated on a crankshaft 2 is indicated in a cylinder 4. In the embodiment illustrated, the crankshaft 2 is connected to an inlet camshaft 6 and an outlet camshaft 7 via a traction mechanism 5. A first and a second device 11 for variably setting the control times of gas exchange valves 9, 10 of an internal combustion engine 1 are capable of ensuring relative rotation between the crankshaft 2 and camshafts 6, 7. Cams 8 of the camshafts 6, 7 actuate one or more inlet gas exchange valves 9 and one or more outlet gas exchange valves 10 respectively. There may also be provision for equipping only one of the camshafts 6, 7 with a device 11 or for providing only one camshaft 6, 7 which is equipped with a device 11.

Figure 3:
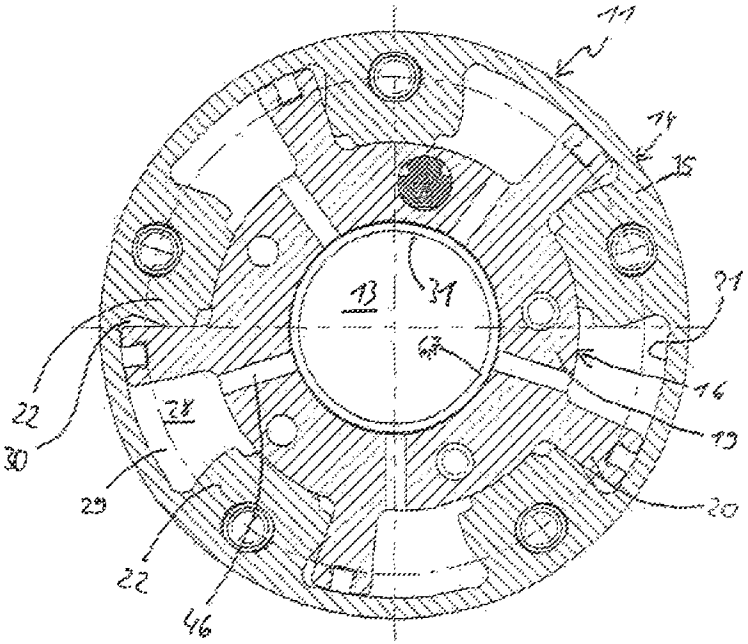
FIG. 3 shows a cross section through the device from FIG. 2 along the line III-III.
Figure 2:
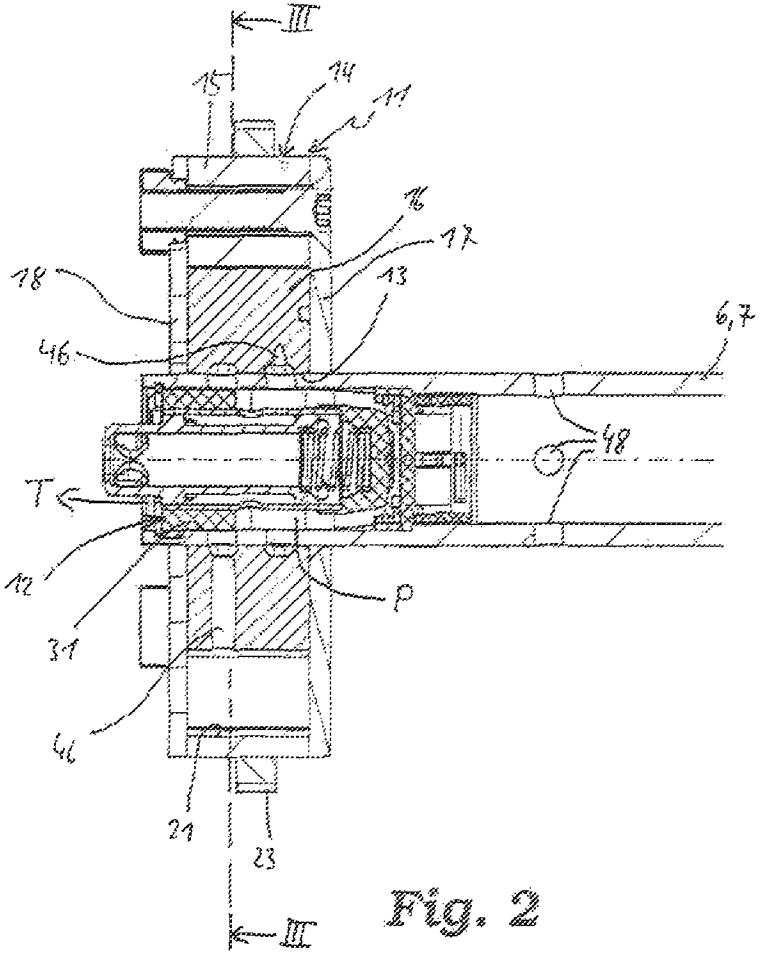
FIG. 2 shows a longitudinal section through a device for variably setting the control times of gas exchange valves of an internal combustion engine by means of a control valve according to the invention.

FIGS. 2 and 3 show a device 11 in longitudinal section and in cross-section respectively. A camshaft 6, 7 and a control valve 12 according to the invention are additionally illustrated in FIG. 2.

The device 11 comprises a drive element 14 and a driven element 16. The drive element 14 is composed of a housing 15 with two side covers 17, 18 which are arranged on the axial side faces of the housing 15 and are fastened to the latter by means of screws. The driven element 16 is designed in the form of an impeller and has an essentially cylindrically designed hub element 19, from the outer cylindrical surface area of which five vanes 20 extend outward in the radial direction in the embodiment illustrated.

Starting from an outer circumferential wall 21 of the housing 15, five projections 22 extend radially inward. In the embodiment illustrated, the projections 22 and the vanes 20 are formed in one part with the circumferential wall 21 and with the hub element 19 respectively. Embodiments will likewise be envisaged in which the vanes 20 and/or the projections 22 are designed as separately manufactured components which are subsequently mounted on the corresponding component. The drive element 14 is mounted on the driven element 16 rotatably in relation to the latter by means of radially inner circumferential walls of the projections 22.

Formed on an outer surface area of the first housing 15 is a chain wheel 23, via which torque can be transmitted from the crankshaft 2 to the drive element 14 by means of a chain mechanism, not illustrated. The driven element 16 has a central orifice 13 which is pierced by the camshaft 6, 7. In this case, the driven element 16 is fastened fixedly in terms of rotation to the camshaft 6, 7 by means of a press fit.

A pressure space 28 is formed inside the device 11 in each case between two projections 22 adjacent in the circumferential direction. Each of the pressure spaces 28 is delimited in the circumferential direction by mutually opposite projections 22 adjacent to essentially radially running boundary walls, in the axial direction, by the side covers 17, 18, radially inward by the hub element 19 and radially outward by the circumferential wall 21. A vane 20 projects into each of the pressure spaces 28. The vanes 20 are designed in such a way that they bear both against the side covers 17, 18 and against the circumferential wall 21. Each vane 20 thus divides the respective pressure space 28 into two pressure chambers 29, 30 acting opposite to one another.

By the action of pressure upon one group of pressure chambers 29, 30 and by the relief of pressure from the other group, the face position of the drive element 14 in relation to the driven element 16 and consequently the phase position of the camshaft 6, 7 in relation to the crankshaft 2 can be varied. By the action of pressure upon both groups of pressure chambers 29, 30, the phase position can be kept constant.

Pressure medium is supplied to the device 11 via the interior of the camshaft 6, 7 which is of hollow form in the embodiment illustrated, and via a control valve 12 arranged in the receptacle 31 of the camshaft 6, 7.

Figure 4:
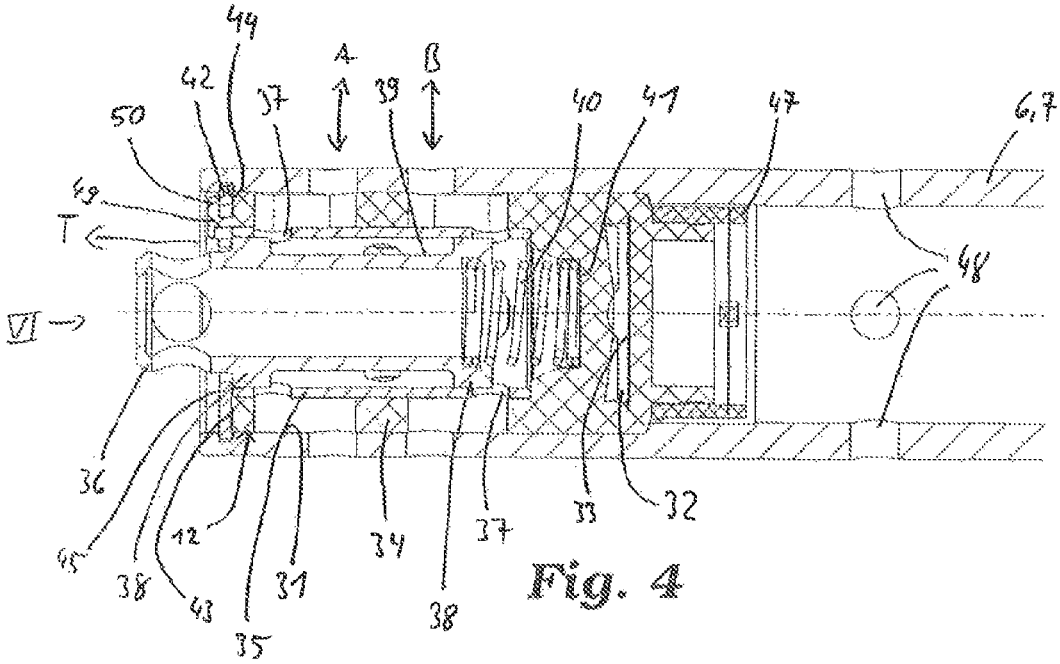
FIG. 4 shows an enlarged view of FIG. 2, only the camshaft and control valve being illustrated and the sectional plane having been tilted through 45° in the circumferential direction.

FIG. 4 shows the control valve 12 inside the camshaft 6, 7 in an enlarged illustration. The control valve 12 has an essentially hollow-cylindrically designed valve housing 34, a cylindrical sleeve 35 and an essentially hollow-cylindrical control piston 36.

Figure 5:
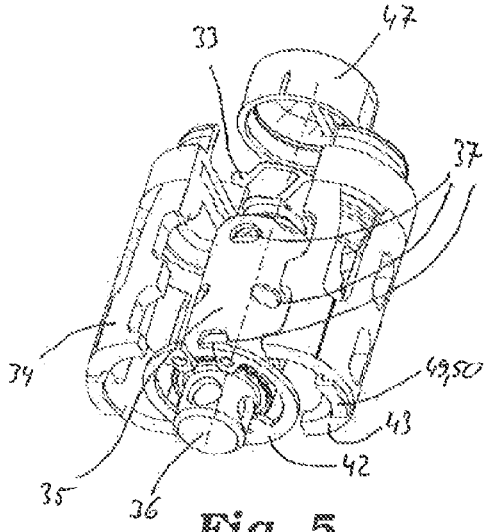
FIG. 5 shows the control valve from FIG. 4 in an exploded illustration.

One radial inflow connection P, two radial working connections A, B and one axial outflow connection T are formed on the valve housing 34. The outflow connection T is designed as an axial orifice on the valve housing 34. The working connections A, B are designed as radial orifices on the surface area of the valve housing 34, each of the working connections A, B communicating with a group of pressure chambers 29, 30 via pressure medium ducts 46 formed in the driven element 16. The inflow connection P is likewise designed as a radial orifice on the surface area of the valve housing 34, said inflow connection being arranged so as to be offset in the circumferential direction to the working connections A, B and being designed as a long hole (FIG. 5). The inflow connection P extends in the axial direction as far as a nonreturn valve receptacle 32 which communicates via an axial orifice, not illustrated, with the interior of the camshaft 6, 7. Arranged in the nonreturn valve receptacle 32 is a spring plate 33 which is prestressed against the axial orifice, not illustrated, so as to implement a nonreturn valve which permits a flow of pressure medium from the camshaft 6, 7 to the inflow connection P and which shuts off an opposite flow of pressure medium. Upstream of the nonreturn valve, a pot-shaped filter element 47 is fastened to the valve housing 34.

The valve housing 34 is arranged inside the camshaft 6, 7, the axial position of which valve housing is defined by a shoulder, formed on the inner surface area of the camshaft 6, 7 and the outer surface area of the valve housing 34, and a securing ring 42. The securing ring 42 projects beyond the valve housing 34 in the radial direction, is arranged in an annular groove 44 formed on the inner surface area of the camshaft 6, 7 and bears against an axial side face 43 of the valve housing 34.

Inside the valve housing 34 is arranged the sleeve 35, the outside diameter of which is adapted to the inside diameter of the valve housing 34. The sleeve 35 has a plurality of orifices 37, each of the orifices 37 communicating with one of the working connections A, B or with the inflow connection P.

The control piston 36 is received axially displaceably inside the sleeve 35. The control piston 36 has two control sections 38, the outside diameters of which are adapted to the inside diameter of the sleeve 35. A groove 39 running annularly around the control piston 36 is provided between the control sections 38.

Figure 6:
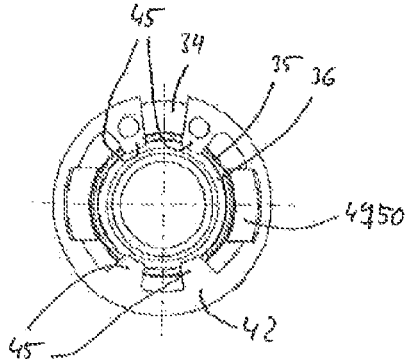
FIG. 6 shows a top view of the control valve according to the arrow VI in FIG. 4.

The control piston 36 can be positioned in relation to the valve housing 34 in the axial direction, counter to the force of a spring element 40, by means of an electromagnetic actuating unit, not illustrated, which acts on that end of the control piston 36 which faces away from the camshaft 6, 7. The spring element 40 is arranged in a spring receptacle 41 formed on the valve housing 34 and is supported, on the one hand, on the spring receptacle 41 and, on the other hand, on the control piston 36. In this case, the travel of the control piston 36 in the axial direction is limited, on the one hand, by the spring receptacle 41, and, on the other hand, by radially inward-extending sections 45 of the securing ring 42 (FIGS. 4-6).

Depending on the position of the control piston 36 in relation to the valve housing 34, one of the working connections A, B is connected to the inflow connection P, while at the same time the other working connection A, B is connected directly or via the interior of the control piston 36 to the outflow connection T. In this case, control edges, by means of which the streams of pressure medium are controlled, are formed on the control sections 38 of the control piston 36 and the orifices 37 of the sleeve 35.

When the internal combustion engine 1 is in operation, pressure medium is supplied to the interior of the camshaft 6, 7 via camshaft orifices 48 by a pressure medium pump, not illustrated. The pressure medium passes through the filter element 47, via the axial orifice, not illustrated, in the valve housing 34 and the spring plate 33 to the inflow connection P and, from there, into an annular space which is delimited by the groove 39 formed on the control piston 36 and by the sleeve 35.

Depending on the position of the control piston 36 in relation to the valve housing 34, the pressure medium is conducted to the first or to the second pressure chambers 29, 30. At the same time, pressure medium passes from the other pressure chambers 29, 30 via the outflow connection T to a pressure medium reservoir, not illustrated, of the internal combustion engine 1. A variation in the phase position of the driven element 16 in relation to the drive element 14 and consequently of the camshaft 6, 7 in relation to the crankshaft 2 thereby takes place. When the desired phase position is reached, the electromagnetic actuating unit, not illustrated, displaces the control piston 36 into a neutral position in which pressure medium is supplied to both groups of pressure chambers 29, 30, so that the relative phase position is kept constant.

Two hook-shaped formfit elements 49 which are spaced apart in the circumferential direction are formed on the axial side face 43 against which the securing ring 42 bears, which formfit elements 49 are designed to be open radially outward. Each of the formfit elements 49, starting from the side face 43, first extends in the axial direction and has an adjoining radial section 50. The formfit elements 49 engage behind the securing ring 42 in the axial direction, so that the latter is received captively between the axial side face 43 and the radial sections 50. When the control valve 12 is being mounted, first, the sleeve 35, spring element 40 and control piston 36 are positioned inside the valve housing 34. The slotted securing ring 42 is thereafter bent open elastically by means of a circumferentially directed force, and is positioned on the side face 43. The action of force is thereafter terminated so that the securing ring 42 resumes its original shape with a smaller diameter and is thus fastened to the valve housing 34. On account of the radially inward-extending sections 45, both the sleeve 35 and the control piston 36 and consequently the spring element 40 are received captively in the valve housing 34, so that the entire control valve 12 can be delivered as a subassembly to the assembly line, without the fear that components may be lost.

When the control valve 12 is being mounted in the camshaft 6, 7, the control valve 12 is pushed into the latter until the shoulder of the valve housing 34 comes to bear against the shoulder of the camshaft 6, 7. In this case, the securing ring 42, when it enters the camshaft 6, 7, is compressed elastically. In the region of the annular groove 44, the securing ring 42 expands and automatically engages into the latter, so that the axial position of the control valve 12 inside the camshaft 6, 7 is defined. As well as the simple mounting of the control valve 12 in the camshaft 6, 7, one advantage of the control valve 12 according to the invention in the plug-in type of construction is that it can be delivered as a module to the assembly line, without the fear that one of the components, namely the control piston 36, spring element 40, securing ring 42 or sleeve 35, may be lost.

Figure 7:
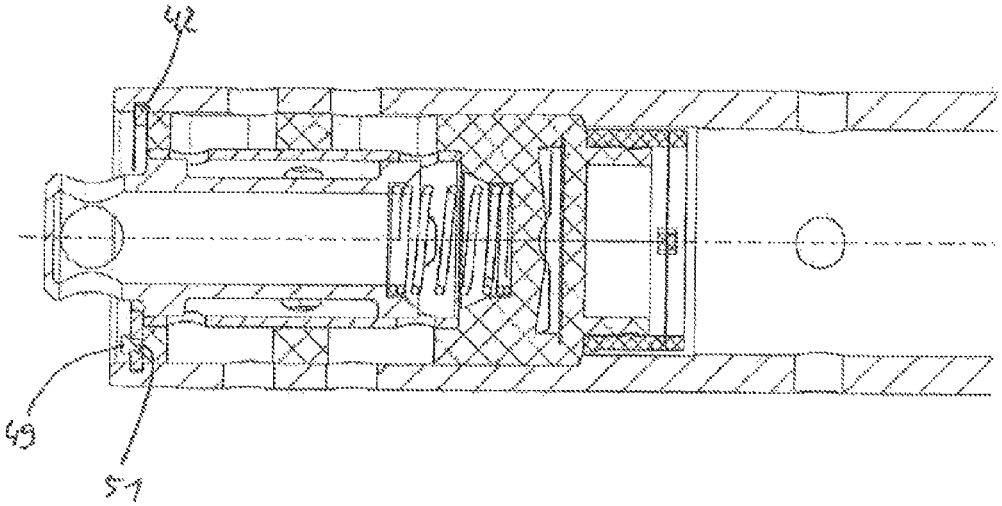
FIG. 7 shows a further embodiment according to the invention of a control valve in an illustration similar to that of FIG. 4.

FIG. 7 shows a further embodiment of a control valve 12 according to the invention similar to the illustration in FIG. 4. In contrast to the first embodiment, the fastening of the securing ring 42 to the valve housing 34 is realized by means of a clip connection. For this purpose, the securing ring 42 has a through opening 51, through which an axially extending positively locking element 49 reaches which is provided with barbs and is formed on the valve housing 34.

The valve housings 34 which are introduced can be configured in one piece or multiple pieces. In the case of valve housings 34 which are formed from a plurality of axially extending part sections with open ends which lie opposite one another in the circumferential direction, a positively locking element 49 is preferably formed on each of the part sections, with the result that the part sections are likewise secured relative to one another by the securing ring 42.

The valve housings 34 may be manufactured, for example, from steel, aluminum or plastic.

REFERENCE SYMBOLS

1 Internal Combustion Engine
2 Crankshaft
3 Piston
4 Cylinder
5 Traction Mechanism
6 Inlet Camshaft
7 Outlet Camshaft
8 Cam
9 Inlet Gas Exchange Valve
10 Outlet Gas Exchange Valve
11 Device
12 Control Valve
13 Central Orifice
14 Drive Element
15 Housing
16 Driven Element
17 Side Cover
18 Side Cover
19 Hub Element
20 Vane

21 Circumferential Wall
22 Projection
23 Chain Wheel
24 -
25 -
26 -
27 -
28 Pressure Space
29 First Pressure Chamber
30 Second Pressure Chamber
31 Receptacle
32 Nonreturn Valve Receptacle
33 Spring Plate
34 Valve Housing
35 Sleeve
36 Control Piston
37 Orifice
38 Control Section
39 Groove
40 Spring Element
41 Spring Receptacle
42 Securing Ring
43 Side Face
44 Annular Groove
45 Section
46 Pressure Medium Duct
47 Filter Element
48 Camshaft Orifices
49 Formfit Element
50 Radial Section
51 Through Orifice
A First Working Connection
B Second Working Connection
P Inflow Connection
T Outflow Connection

The invention claimed is:

1. A control valve for a device for variably setting control times of gas exchange valves of an internal combustion engine, comprising:

a receptacle having an inner circumferential face with an annular groove formed on the inner circumferential face;

a substantially hollow-cylindrical valve housing, which has an axial side face, arranged in the receptacle inside the device;

a control piston arranged displaceably inside the valve housing;

a securing ring projecting beyond the valve housing in a radial direction, bears against the axial side face of the valve housing, and is engageable in the annular groove formed on the inner circumferential face of the receptacle; and at least one positively locking element formed on the valve housing so as to fasten the securing ring to the valve housing.

2. The control valve as claimed in claim 1, wherein the at least one positively locking element is formed on the axial side face of the valve housing against which the securing ring bears.

3. The control valve as claimed in claim 1, wherein two positively locking elements, which each have a radially extending section, are formed in the region of the side face of the valve housing against which the securing ring bears, the positively locking elements are hook-shaped and configured so as to be open radially outwardly and engage behind the securing ring in an axial direction so that the securing ring bears both against the axial side face of the valve housing and against the radially extending section of each of the positively locking elements.

4. The control valve as claimed in claim 1, wherein the securing ring has a radially inwardly extending section which serves as an axial stop for the control piston.

* * * * *